United States Patent [19]

Snyder

[11] 4,142,260

[45] Mar. 6, 1979

[54] CHEMICAL DISPENSER FOR FLUSH TYPE WATER TANK TOILETS

[76] Inventor: Ralph E. Snyder, Box 193, Black Canyon Stage, Phoenix, Ariz. 85020

[21] Appl. No.: 503,298

[22] Filed: Sep. 5, 1974

[51] Int. Cl.[2] ..... E03D 9/03

[52] U.S. Cl. ..... 4/223; 4/228

[58] Field of Search ..... 4/228, 227, 222, 224, 4/223, 225; 222/185, 193, 61, 64

[56] References Cited

U.S. PATENT DOCUMENTS

| | | | |
|---|---|---|---|
| 2,647,266 | 8/1953 | Vierra | 4/227 |
| 2,736,039 | 2/1956 | Majo | 4/227 |
| 2,993,214 | 7/1961 | Franco | 4/228 |
| 3,228,040 | 1/1966 | Currie | 4/226 |
| 3,890,657 | 6/1975 | Gray | 4/228 |

FOREIGN PATENT DOCUMENTS

| | | | |
|---|---|---|---|
| 360143 | 11/1931 | United Kingdom | 4/227 |
| 705904 | 3/1954 | United Kingdom | 4/228 |

*Primary Examiner*—Joseph F. Peters, Jr.
*Assistant Examiner*—Norman L. Stack, Jr.
*Attorney, Agent, or Firm*—Cahill, Sutton & Thomas

[57] ABSTRACT

A dispenser, positionable within the standpipe of a tank-type toilet, dispenses a quantity of chemicals into the toilet bowl during each flushing cycle.

29 Claims, 4 Drawing Figures

CHEMICAL DISPENSER FOR FLUSH TYPE WATER TANK TOILETS

BACKGROUND OF THE INVENTION

The present invention relates to chemical dispensers and, more particularly, to chemical dispensers for use in flush type toilets.

Hygienic considerations and the formation of unattractive discoloration within toilet bowls have given rise to a major industry, which industry has produced and continues to develop products in an attempt to satisfy the hygienic requirements and eliminate the discoloration. A general solution to these problems revolves around a chemical dispenser disposed within the water tank of the toilet. The dispenser emits a predetermined amount of chemical into the water tank, which chemical, during the water flushing cycle, rinses the toilet bowl.

All toilet water tanks incorporate at least some metallic components and older water tanks have almost exclusively metallic operating elements. The use of any metallic materials within the water tank necessarily precludes the dispensation therein of any chemicals which might oxidize or otherwise chemically react with the metallic elements. Therefore, the highly efficient disinfectants which incorporate chlorine cannot be dispensed into the water tank. Similarily, chemicals having an acidic PH factor and which would alleviate discoloration of the toilet bowl by preventing metallic oxide build up on the surface thereof cannot be dispensed into the water tank. Thus, the type and nature of chemicals dispensible by water tank dispensers is limited to other than the optimum choices.

The prior art chemical dispensing apparatus usually employed one of two types of mechanisms: a float valve operated mechanism for dispensing a predetermined quantity of chemical into the toilet tank in response to the cyclical water discharge; or, a pressure responsive mechanism for regulating the amount of chemical dispensed in compliance with the degree of pressure change.

Although the amount of water within a water tank is intended to be uniformly consistent after each fill cycle, some variation does occur because of varying water pressure, sticking water valves, etc. Similarly, the water tank does not always drain completely and more or less water may remain therein after each cycle. These variations in the amount of water discharged affect the concentration of dispensed chemicals and, hence, alter the effectiveness of the chemicals.

To overcome the necessity for dispensing chemicals into the toilet tank, various suspended devices have been mounted within the toilet bowl itself. Devices of this type have generally received limited acceptance for home use in that they impede periodic cleaning of the bowl and are often disturbed or dislodged during normal use of the toilet.

PURPOSE OF THE INVENTION

It is therefore a primary object of the present invention to provide a chemical dispenser for toilets which dispenses the chemical directly from within the standpipe into the toilet bowl so that the chemical does not come into contact with the tank walls.

Another object of the present invention is to provide a means for dispensing chlorine disinfectants into a toilet bowl from a supply of the disinfectants disposed within the standpipe of a water-tank type toilet.

Still another object of the present invention is to provide a means for chemically eliminating oxide build up within a toilet bowl.

Yet another object of the present invention is to eliminate the need for dispensing chemicals into the water tank of the toilet.

A further object of the present invention is to provide a means for selecting disinfectant and cleaning compounds for toilet bowls irrespective of the chemical composition of the apparatus disposed within the toilet water tank.

A still further object of the present invention is to provide a chemical dispenser for toilets which injects the chemical into the bowl refill water only during the flushing cycle.

A yet further object of the present invention is to provide a chemical dispenser which dispenses a predeterminable quantity of chemical during each flushing cycle.

A yet another and further object of the present invention is to provide a non-critically mounted chemical dispenser for tank type toilets.

SUMMARY OF THE INVENTION

The invention is directed to a method and apparatus for dispensing a cleaning and disinfectant chemical compound into a conventional tank-type flush toilet having tank walls and a standpipe. A reservoir or supply of fluid containing the chemical compound is disposed within the standpipe. The fluid is then dispensed into the flow of water directed through the standpipe into the toilet bowl upon flushing of the toilet. The flow of water actually causes the dispensing of the fluid containing the chemical compound. The dispenser comprises an elongated tube for housing a reservoir of fluid containing the chemical compound. The tube has a structural configuration effective to be inserted within the standpipe to dispose the fluid within the standpipe. The tube includes a closed upper end and a dispensing lower end. The closed upper or top end includes a head space adjacent the upper level of the housed chemical compound when the tube is disposed in a substantially vertical direction. The lower end includes means effective to dispense a quantity of the fluid containing the chemical compound into water which is directed through the standpipe during a flush cycle when the tube is inserted in the standpipe. The quantity of the chemical compound is discharged from the reservoir in the tube and directly into the toilet bowl.

BRIEF DESCRIPTION OF DRAWINGS

These and other objects of the present invention will become apparent to those skilled in the art as the description thereof proceeds.

The present invention will be described with greater specificity and clarity with reference to the following drawings, in which.

DESCRIPTION OF SPECIFIC EMBODIMENTS

Water flushing toilets from home use usually include a water tank located above and behind the toilet bowl. A ball cock valve assembly, selectively operated by a manually operated handle, releases the water stored within the water tank through a ball valve system into the toilet bowl. A float within the water tank and dropping with the water level, opens the ball cock valve assembly and refills the water tank upon closure of the ball valve. Simultaneously, a refill tube conveys a limited flow of water from the ball cock valve assembly to a standpipe. The standpipe opens directly into the toilet bowl and serves two purposes. First, should the ball cock valve assembly malfunction and not shut off the inflowing water at a predetermined water level, the excess water will flow through the standpipe into the toilet bowl and discharge therefrom. Second, the water flowing through the refill tube flows through the standpipe into the toilet bowl and refills it to a predeterminable level.

Figure 1:
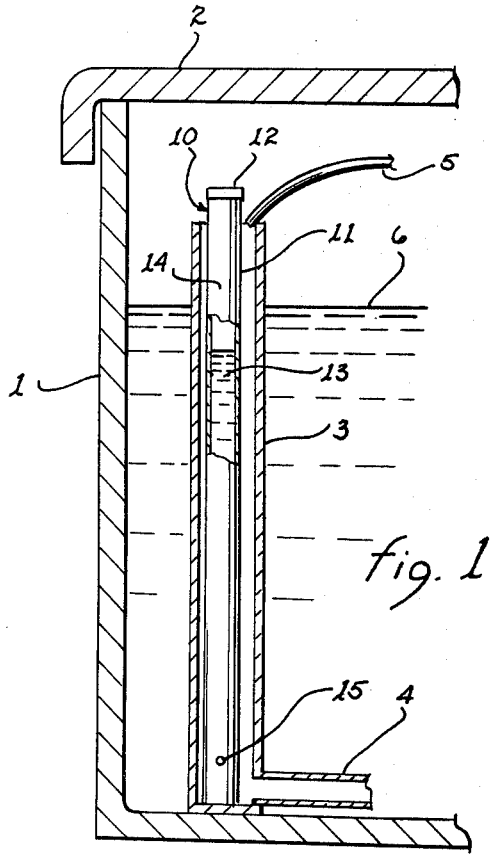
FIG. 1 illustrates the present invention mounted within the water tank of a flush type toilet.

Referring to FIG. 1, there is shown a toilet water tank 1 having a cover 2. A representatively illustrated standpipe 3 has a bottom wall portion as shown and is located within tank 1 and communicates with an associated toilet bowl (not shown) through a conduit 4. It is to be understood that the actual physical configuration of the standpipe and conduit may be different from that shown. A refill tube 5 extends from a ball cock valve (not shown) and empties into the upper end of standpipe 3. Generally, the water level 6 within tank 1 is somewhat below the upper open end of the standpipe.

In describing a chemical dispenser constructed in accordance with the teachings of the present invention, joint reference will be made to FIGS. 1 and 2. Dispenser 10 is formed of a length of tubing which, as is evident from the drawings, has a structural configuration effective to be inserted within standpipe 3 without obstructing the flow of water through the standpipe. The tubing may be plastic to reduce its cost provided that the composition of the plastic is non-reactive with the chemical composition to be contained therein. The bottom or lower end of tube 11 is shown in contact with the bottom wall portion of standpipe 3. The lower end of tube 11 is closed by a plate or heated and crimped if the tube is of thermalsetting plastic. Similarly, the upper end of the tube is closed by a cap 12 or crimped by heat means. Prior to the closing of the upper end of tube 11, the cleaning and/or disinfecting fluid 13 is inserted therein. Generally, a less than complete fill of tube 11 is preferred in order to provide a limited amount of head space 14. At a point approximately one inch above the lower end of tube 11, a small fluid dispensing hole 15 is formed. By experiment it has been determined that a hole of approximately 1/32 of an inch in diameter functions quite well. The fluid dispensation is further enhanced if the longitudinal axis of hole 15 within the side wall of tube 11 is oriented upwardly and inwardly at an angle of approximately 45° with respect to vertical.

In operation, dispenser 10 is inserted within standpipe 3 as illustrated in FIG. 1. Thus, as shown, tube 11 houses a supply or reservoir of fluid 13 containing a chemical compound. Consequently, fluid 13 is disposed within the standpipe 3. Normally, the standpipe is devoid of water as any water therein has flowed through conduit 4 into the toilet bowl. After the toilet has been flushed and during refilling of water tank 1, water flows through refill tube 5 into the standpipe and ultimately into the toilet bowl. As the water flows downwardly through the standpipe 3, it will flow adjacent the surface of dispenser 10 and across hole 15. In other words, tube 11 is adapted to fit inside standpipe 3 without obstructing the flow of water, which flow of water activates the dispensing operation of dispenser 10. In accordance with Bernoulli's principle, the water flowing across hole 15 will establish a low pressure environment, being lower than that within head space 14, will result in an outflow of fluid 13 through hole 15. The outflowing fluid will mix with and be conveyed by the water flowing into the toilet bowl. Thus, as is evident herein, a dispensing means is responsive to the flow of water through the standpipe 3 and over the elongated tube 11 while simultaneously preventing water from entering tube 11 whereby a limited quantity of fluid 13 is dispensed into the flow of water and delivered to the toilet bowl. This quantity of chemical compound may be discharged either during or after completion of the flush cycle.

From the above description it will be appreciated that the fluid 13 only contacts the lower end of standpipe 3, conduit 4 and the surface of the toilet bowl. Thereby, it becomes necessary only that standpipe 3, conduit 4 and the toilet bowl, be chemically compatible with fluid 13. Whether or not the remaining components within water tank 1 are similarly compatible is wholly incidental and the selection of such components can be based on other criteria of economy, utility and wear characteristics.

In some of the prior art devices, careful precautions must be taken in locating the chemical dispenser at an appropriate height within the water tank commensurate with the maximum water level. This requirement often results in improperly mounted and therefore improperly functioning dispensers. Further, the chemical dispensed into the water tank must be non-reactive with every component of the water tank to prevent damage to the component or to sustain the disinfecting and cleaning ability of the dispensed chemical. Where such dispensers are mounted in seldom used toilet tanks, the utility of the dispensed fluid is often negatively affected; or, leakage from the dispenser can result in an inordinate concentration of chemicals.

The present invention, however, can be easily and simply dropped into the standpipe. No positioning or careful mounting is necessary. Equally simply, it may be removed or replaced by grasping the upper end thereof and withdrawing it from the standpipe.

Through experiment, it has been learned that lesser or greater than optimum dispensation of fluid 13 resulted depending upon the radial orientation of hole 15 with respect to the course of the major water flow through the standpipe. It is believed that the varying or variable dispensation rate was a direct function of the relative diameters between tube 11 and standpipe 3 and the spacing intermediate hole 15 and the opposing surface of the standpipe. That is, the rate of water flow resulted in a proportional pressure drop adjacent hole 15, which pressure drop is a function of the rate of discharge of fluid 13.

Figure 3:
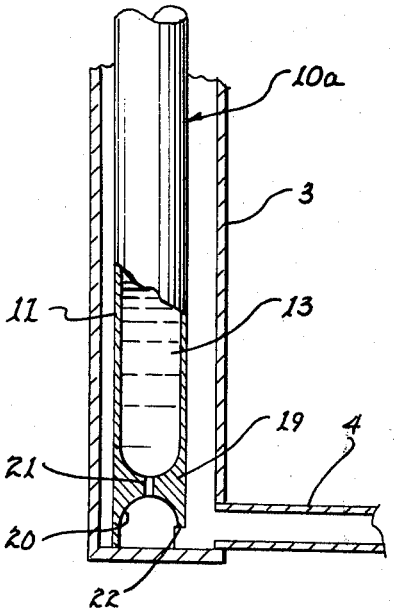
FIG. 3 illustrates a first variant of the present invention.

Much experimentation was performed to overcome the differing dispensation rate depending upon the orientation of dispenser 10 and resulted in the first variant dispenser **10*a* shown in FIG. 3. The lower end of dispenser 10 was modified by adding a sealed section 19 across the lower end of the dispenser and forming a capillary passageway 21** having a diameter on the order of 0.055 inches through the sealed section. Passageway 21 opens into an open ended bell shaped chamber 20. A part of the lower skirt of the chamber was cut away to form a slot 22.

The operation of dispenser 10*a* is described below. The capillary nature of passageway 21, in combination with the head space 14 (see FIG. 2), is sufficient to overcome the pressure exerted by fluid 13 at the opening to passageway under quiescent conditions. During the flush cycle, the toilet bowl fill water courses through standpipe 3 and conduit 4. The water flowing past slot 22 creates a low pressure environment within the air pocket defined by bell shaped chamber 20. A reduction in pressure at the outlet of passageway 21 and within the bell shaped chamber 20 tends to cause fluid discharge through the passageway. The discharged fluid 13 mixes with the water flowing through standpipe 3 and conduit 4 and is conveyed therewith into the toilet bowl. When the water ceases to flow through the standpipe and the attached conduit, the quiescent condition is once more resumed within the bell shaped chamber 20 and further discharge of fluid 13 is preempted.

Figure 2:
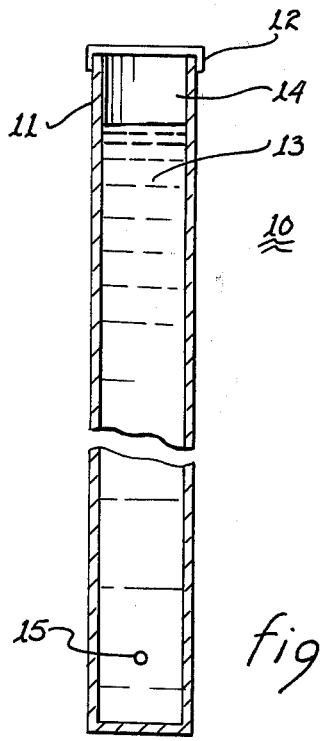
FIG. 2 illustrates the present invention.

By experiment it has been learned that the orientation of slot 22 for dispenser 10*a* is substantially less critical in maintaining a predetermined discharge rate of the fluid 13 than the orientation of dispenser 10 (see FIG. 2).

Figure 4:
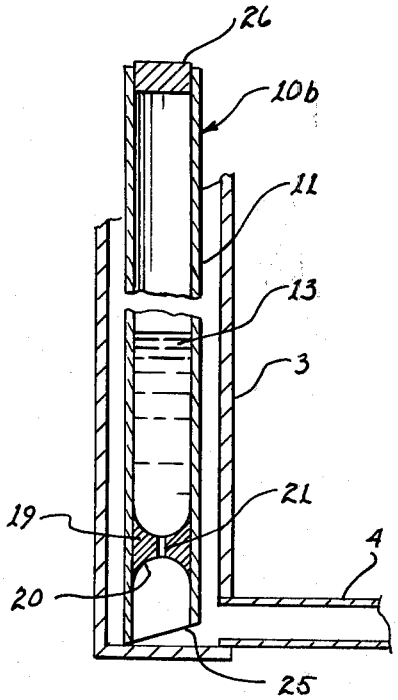
FIG. 4 illustrates a second variant of the present invention.

To simplify the manufacture of the present invention and in an effort to further increase its efficiency, the variant dispenser 10*b* illustrated in FIG. 4 was developed.

Dispenser 10*b* primarily varies from dispenser 10*a* in that slot 22 has been eliminated. Instead, the lower end of the dispenser is cut at an angle to form slanted end 25. By using a slanted end 25, water flowing adjacent almost any part of the lower periphery of tube 11 adjacent the slanted end will, according to Bernoulli's principle, create a low pressure area. The low pressure area adjacent the slanted end 25 is transmitted to and affects the pressure of the air pocket within the bell shaped chamber 20. Thereby, there is no need to orient dispenser 10*b* into any preferred position within standpipe 3 as any orientation of the dispenser will result in at least some fill water flowing adjacent at least some part of slanted end 25 to create a low pressure within the bell shaped chamber.

As may be noted in FIG. 4, either a cap 12 may be used to seal the upper end of tube 11 or a stopper 26 may be so employed.

In the preferred embodiment, the inside diameter of tube 11 should be approximate $\frac{3}{8}$ of an inch. With this diameter and a length sufficient to accommodate 18–22 milliliters of fluid, the dispenser (10, 10*a* or 10*b*) will accommodate and discharge fluid for at least 150 flushes. It has also been learned that the rate of discharge varies very little, if any, between the first and the last flushes. Thus, the present invention provides an extremely well regulated fluid dispenser which is independent of the height of the water level within the tank, the flush cycle rate or other to be expected variations in water volume and water flow.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

I claim:

1. A dispenser mountable within the standpipe of water tank type toilets for dispensing cleaning and disinfectant fluid chemical compounds into the toilet bowl during each flush cycle of the toilet and preventing intermixing of the chemical compound with the body of water contained within the water tank, said dispenser comprising:

a. an elongated tube for housing the chemical compound, which chemical compound is periodically incrementally dispensed into the toilet, said tube being positionable within the standpipe in general alignment with the longitudinal axis thereof, and including:

(1) a closed upper end for establishing a head space adjacent the upper level of the housed chemical compound; and (2) a lower end for dispensing the chemical compound into the water within the standpipe during each flush cycle; and b. means disposed within said lower end for discharging a quantity of the chemical compound in response to a flow of water through the standpipe and proximate said lower end; whereby, a quantity of the chemical compound is discharged from said dispenser and into the toilet bowl during each flush cycle of the toilet without coming into contact with the walls of the water tank.

2. The dispenser as set forth in claim 1 wherein said discharge means comprises an aperture disposed in the wall of said tube.

3. The dispenser as set forth in claim 2 wherein the said lower end of said tube is closed beneath said aperture.

4. The dispenser as set forth in claim 3 wherein said aperture is positioned one inch upwardly from said lower end.

5. The dispenser as set forth in claim 1 wherein said discharging means comprises:

a. a chamber formed within said lower end, said chamber being in fluid communication with any water disposed in the standpipe;

b. a sealed section extending across said tube in proximity to said lower end, said sealed section defining the upper extremity of said chamber and the lower end of the part of said tube housing the chemical compound;

c. a capillary passageway extending through said sealed section for discharging the chemical compound into said chamber; and d. means for establishing a low pressure environment within said chamber in response to a flow of water through the standpipe; whereby the low pressure environment draws the chemical compound into said chamber for mixing with the water flowing through the standpipe in proximity to said chamber during each flush cycle of the toilet.

6. The dispenser as set forth in claim 5 wherein said low pressure establishing means comprises an opening disposed through the wall of said chamber.

7. The dispenser as set forth in claim 6 wherein said chamber comprises an open ended bell shaped chamber.

8. The dispenser as set forth in claim 7 wherein said opening comprises a slot extending upwardly from the lower edge of said bell shaped chamber.

9. The dispenser as set forth in claim 5 wherein the bottom of said chamber is open ended.

10. The dispenser as set forth in claim 9 wherein the bottom of said chamber is slanted with respect to the longitudinal axis of said tube.

11. The dispenser as set forth in claim 10 wherein said chamber is bell shaped.

12. The combination comprising:

a. a tank-type flush toilet having tank walls and a standpipe, and b. a dispenser disposed within said standpipe and being effective to dispense a cleaning and disinfectant chemical compound into the toilet bowl during a flush cycle of the toilet, c. said dispenser comprising an elongated tube for housing a supply of fluid containing the chemical compound, d. said tube having a closed top end and a bottom end and having dispensing means including an opening formed within the side of the tube, and e. said dispensing means being responsive to a flow of water through the standpipe and over the elongated tube while simultaneously preventing water from entering said tube to dispense a limited quantity of said fluid containing the chemical compound into the flow of water being directed through the standpipe into the toilet bowl.

13. A method for dispensing a cleaning and disinfectant chemical compound into the toilet bowl during a flush cycle of a tank-type toilet having tank walls and a standpipe, said method comprising method:

a. providing a supply of fluid containing the chemical compound within the standpipe of said toilet, b. providing a means to dispense fluid from said supply within said standpipe, c. directing a flow of water through the standpipe to activate the dispensing means for dispensing the fluid into said directed flow of water, and d. said water being directed into the toilet bowl from said standpipe.

14. A dispenser for dispensing a cleaning and disinfectant chemical compound into the toilet bowl during a flush cycle of a water-tank type toilet having tank walls and a standpipe, said dispenser comprising:

a. an elongated tube for housing a reservoir of fluid containing the chemical compound, b. said tube having a structural configuration effective to be inserted within said standpipe to dispose said fluid within said standpipe, c. said tube including a closed upper end and a dispensing lower end, d. said closed upper end including a head space adjacent the upper level of the housed chemical compound when the tube is disposed in a substantially vertical direction, e. said lower end including discharge means effective to dispense a quantity of the fluid containing the chemical compound into water which is directed through the standpipe during a flush cycle when the tube is inserted in said standpipe, and f. said quantity of the chemical compound being discharged from said reservoir in the tube and directly into the toilet bowl.

15. The dispenser as set forth in claim 14 wherein said discharge means comprises an aperture disposed in the wall of said tube.

16. The dispenser as set forth in claim 14 wherein said discharge means comprises:

a. a chamber formed within said lower end, b. a sealed section extending across said tube in proximity to said lower end and defining the upper extremity of said chamber and the lower end of the part of said tube containing the chemical compound, c. a capillary passage way extending through said sealed section for discharging the chemical compound into said chamber, and d. means for establishing a low pressure environment within said chamber in response to a flow of water through the standpipe whereby the chemical compound is discharged into said chamber for mixing with the water flowing through the standpipe into the toilet bowl.

17. The dispenser as set forth in claim 16 wherein said low pressure establishing means comprises an opening disposed through the wall of said chamber.

18. The dispenser as set forth in claim 17 wherein said chamber comprises an open-ended bell shaped chamber.

19. The dispenser as set forth in claim 18 wherein said opening comprises a slot extending upwardly from the lower edge of said bell-shaped chamber.

20. The dispenser as set forth in claim 16 wherein the bottom of said chamber is open ended.

21. The dispenser as set forth in claim 20 wherein the bottom of said chamber is slanted with respect to the longitudinal axis of said tube.

22. The dispenser as set forth in claim 21 wherein said chamber is bell shaped.

23. A dispenser for dispensing a cleaning and disinfectant chemical compound into the toilet bowl during a flush cycle of a water-tank type toilet having tank walls and a standpipe, said dispenser comprising:

a. an elongated tube for housing a reservoir of fluid containing the chemical compound, b. said tube having a structural configuration effective to be inserted within said standpipe to dispose said fluid within said standpipe, c. said tube including a closed upper end and a dispensing lower end, d. said closed upper end including a head space adjacent the upper level of the housed chemical compound when the tube is disposed in a substantially vertical direction, e. said structural configuration being effective to be inserted within the standpipe to allow a flow of water directed through the standpipe into the toilet bowl, f. said lower end including discharge means effective to dispense a quantity of the fluid containing chemical compound into the flow of water directed through the standpipe during a flush cycle when the tube is inserted in said standpipe, and g. said quantity of the chemical compound being discharged from said reservoir in the tube and into the toilet bowl.

24. A dispenser located within the standpipe of a conventional tank-type flush toilet, the standpipe being in fluid communication with the bowl of the flush toilet, said dispenser comprising:

a. an elongated tube for housing a cleaning solution;

b. said elongated tube having a closed top end and a bottom end; and c. dispensing means for dispensing the solution, said dispensing means including an opening formed within a side of said elongated tube and responsive to the flow of water through the standpipe, over said elongated tube and into the toilet bowl while simultaneously preventing water from entering said elongated tube; whereby, a limited quantity of the solution is dispensed into the water and delivered to the toilet bowl on completion of a flush cycle.

25. A dispenser located within the standpipe of a conventional tank-type flush toilet, which standpipe includes a bottom wall portion and is in fluid communication with the bowl of the flush toilet, said dispenser comprising:

a. an elongated tube for housing a cleaning solution;

b. said elongated tube including a top and a bottom end;

c. dispensing means for dispensing the solution, said dispensing means being responsive to the flow of water through the standpipe, over said elongated tube and into the toilet bowl while simultaneously preventing water from entering said elongated tube, whereby a limited quantity of the solution is dispensed into the water and delivered to the toilet bowl after completion of a flush cycle;

d. a first seal disposed at said top end of said elongated tube for closing said top end, preventing water from entering said elongated tube and isolating the interior of said elongated tube from atmospheric pressure;

e. a second seal disposed at said bottom end of said elongated tube for housing the solution between said first and second seals;

f. said dispensing means comprising (1) a capillary opening located within said second seal;

(2) an air chamber located between said bottom end and said second seal; and (3) said bottom end of said elongated tube having an open end cut at a slant to the horizontal and being in contact with the bottom wall portion of the standpipe; whereby, a flow of water through the standpipe and over the open bottom end of said elongated tube causes the solution to be dispensed through said capillary opening and said air chamber into the water to be delivered to the toilet bowl.

26. A dispenser according to claim 25 wherein said elongated tube is made of plastic and wherein at least one of said first and second seals is a heat seal extending across said elongated tube.

27. A dispenser located within the standpipe of a conventional tank-type flush toilet, which standpipe includes a bottom wall portion and is in fluid communication with the bowl of the flush toilet, said dispenser comprising:

a. an elongated tube for housing a cleaning solution;

b. said elongated tube including a top end and a bottom end;

c. dispensing means for dispensing the solution, said dispensing means being responsive to the flow of water through the standpipe, over said elongated tube and into the toilet bowl while simultaneously preventing water from entering said elongated tube, whereby a limited quantity of the solution is dispensed into the water and delivered to the toilet bowl after completion fo a flush cycle;

d. a first seal disposed at said top end of said elongated tube for closing said top end, preventing water from entering said elongated tube and isolating the interior of said elongated tube from atmospheric pressure;

e. said elongated tube including a second seal disposed above said bottom end of said elongated tube for housing a solution between said first and second seals; and f. said dispensing means comprising (1) a capillary opening located within said second seal;

(2) an air chamber located between said bottom end and said second seal;

(3) said bottom end of said elongated tube being an open ended walled element and in contact with the bottom wall portion of the standpipe; and (4) a slot provided in the wall of said elongated tube at said bottom end; whereby, flow of water through the standpipe and over said slot and said open bottom end of said elongated tube causes the solution to be dispensed through said capillary opening and said air chamber and into the water to be delivered to the toilet bowl.

28. A dispenser located within the standpipe of a conventional tank-type flush toilet, said standpipe having a bottom wall portion and being in flow communication with a toilet bowl, said dispenser containing:

a. an elongated tube for housing a cleaning solution, b. said tube having a closed top and a bottom end, and having dispensing means responsive to the flow of water through said standpipe and over said elongated tube while simultaneously preventing water from entering said tube whereby a limited quantity of said solution is dispensed into said water and delivered to the toilet bowl after completion of the flush cycle, c. wherein said top end of said tube is closed by a seal, so that the seal prevents water from entering the tube and insolates the interior of the tube from atmospheric pressure, d. wherein said tube has a second seal provided above the bottom end of said tube, so that solution is housed between the first and second seals, e. wherein said dispensing means is comprised of (1) a capillary opening located within said second seal; (2) an air chamber located between the bottom end and said second seal; (3) the bottom end of said tube; and (4) a hole located in the wall of said tube between the second seal and the bottom end of said tube; and f. wherein the bottom end is open and cut at a slant to the horizontal so that flow of water through the standpipe and over the open bottom end of the tube causes the solution to be dispensed through the capillary opening and air chamber into said water to be delivered to the toilet bowl, wherein said bottom end is in contact with the bottom wall portion of said standpipe.

29. A dispenser according to claim 28 wherein said tube is made of plastic and wherein at least one of said seals is a heat seal extending across the tube.

* * * * *